US011472584B2

(12) United States Patent
Chang

(10) Patent No.: US 11,472,584 B2
(45) Date of Patent: Oct. 18, 2022

(54) VACUUM BAG

(71) Applicant: Chi-Yuan Chang, Taichung (TW)

(72) Inventor: Chi-Yuan Chang, Taichung (TW)

( * ) Notice: Subject to any disclaimer, the term of this patent is extended or adjusted under 35 U.S.C. 154(b) by 236 days.

(21) Appl. No.: 17/027,415

(22) Filed: Sep. 21, 2020

(65) Prior Publication Data

US 2022/0089306 A1 Mar. 24, 2022

(51) Int. Cl.

| | |
|---|---|
| ***B65B 31/04*** | (2006.01) |
| ***B65D 33/25*** | (2006.01) |
| ***B65D 30/24*** | (2006.01) |
| ***B65D 81/20*** | (2006.01) |

(52) U.S. Cl.

CPC ..... *B65B 31/04* (2013.01); *B65D 31/14* (2013.01); *B65D 33/25* (2013.01); *B65D 81/2023* (2013.01)

(58) Field of Classification Search

CPC ..... B65B 31/04; B65D 31/14; B65D 33/25; B65D 81/2023

USPC ..... 53/79; 383/103

See application file for complete search history.

(56) References Cited

U.S. PATENT DOCUMENTS

| | | | | |
|---|---|---|---|---|
| 5,142,970 A * | 9/1992 | ErkenBrack | ..... | A23L 3/3418 206/524.8 |
| 2007/0071623 A1* | 3/2007 | Chang | ..... | F04B 33/00 417/480 |
| 2011/0052098 A1* | 3/2011 | Chang | ..... | A45C 13/021 383/3 |
| 2020/0217312 A1* | 7/2020 | Chang | ..... | F04B 49/03 |

* cited by examiner

*Primary Examiner* — Jes F Pascua

(57) ABSTRACT

A vacuum storage apparatus includes a bag and a pump. A zipper is operable to close a mouth of the bag. The pump includes a shell, a bottom plate and two check valves. The shell includes a flange extending from an air bag. The air bag includes a chamber. The flange includes a vent in communication with the chamber and is inserted in and connected to the bag so that the air bag extends out of an aperture of the bag. The bottom plate includes an entrance and is connected to the flange so that the entrance is in communication with the chamber. The first check valve is located between the flange and the bottom plate so that an inlet thereof is in communication with the chamber and an outlet thereof is in communication with the vent. The second check valve is connected to the bottom plate, over the entrance.

14 Claims, 8 Drawing Sheets

VACUUM BAG

BACKGROUND OF INVENTION

1. Field of Invention

The present invention relates to water-proof storage and, more particularly, to a vacuum bag.

2. Related Prior Art

Humid environments are not good for storing things. For example, food such as dried fruit, melon seed and nut could go bad soon in humid environments. Moreover, electronic devices such as cell phones, digital cameras and digital video recorder could easily be damaged in humid environments. In water activities or in journeys in rainy days, personal belongings could easily get wet and damaged. Such personal belongs can be stored in water-proof bags to protect them from water. However, many of such water-proof bags are ineffective.

For example, a cell phone can be stored in a water-proof bag and hence protected from water. However, there is often too much air in the water-proof bag to allow a transparent sheet of the water-proof bag to tightly contact a touch screen of the cell phone. Hence, it is difficult to adequately operate the touch screen via the transparent sheet. Moreover, a camera of the cell phone cannot clearly take photographs via the transparent sheet.

For example, food can be stored in a water-proof bag and hence protected from water. However, there is often too much air in the water-proof bag to prevent the food from getting soft, sticky or even rotten.

To overcome the foregoing problems, air can be driven out of the air-proof bag by a pump. However, it costs money to buy such a pump and it is inconvenient to carry such a pump.

The present invention is therefore intended to obviate or at least alleviate the problems encountered in the prior art.

SUMMARY OF INVENTION

It is the primary objective of the present invention to provide an effective and convenient vacuum storage apparatus.

To achieve the foregoing objectives, the vacuum storage apparatus includes a bag, a zipper and a pump. The bag includes a mouth and an aperture. The zipper is operable to close the mouth. The pump includes a shell, a bottom plate and two check valves. The shell includes a flange extending from an air bag. The air bag includes a chamber. The flange includes a vent in communication with the chamber and is inserted in and connected to the bag so that the air bag extends out of the aperture. The bottom plate includes an entrance and is connected to the flange so that the entrance is in communication with the chamber. The first check valve includes a channel, an inlet, and an outlet in communication with the inlet via the channel and is located between the flange and the bottom plate so that the inlet is in communication with the chamber and the outlet is in communication with the vent. The second check valve is connected to the bottom plate, over the entrance.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
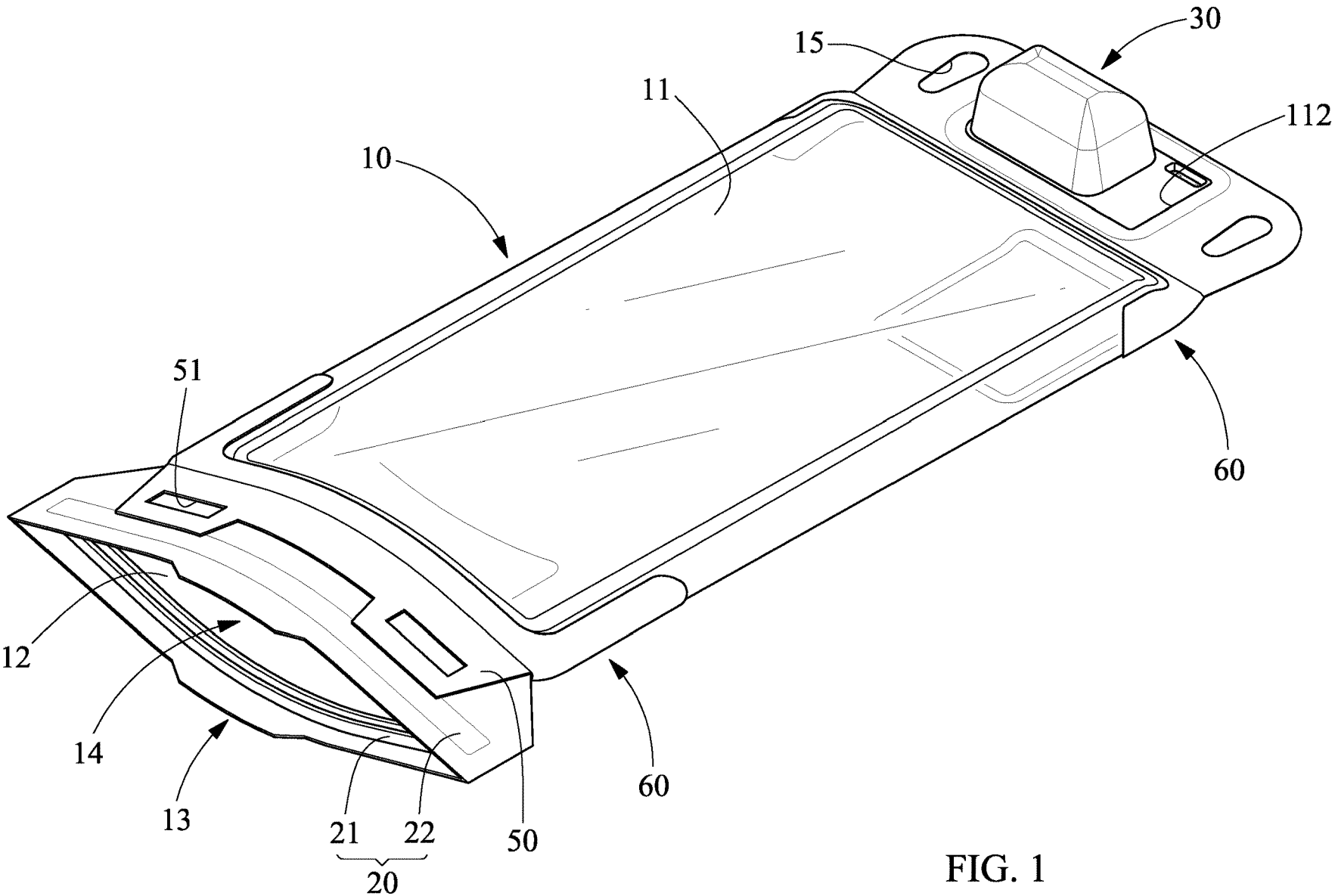
FIG. 1 is a perspective view of a vacuum storage apparatus according to the first embodiment of the present invention.
Figure 2:
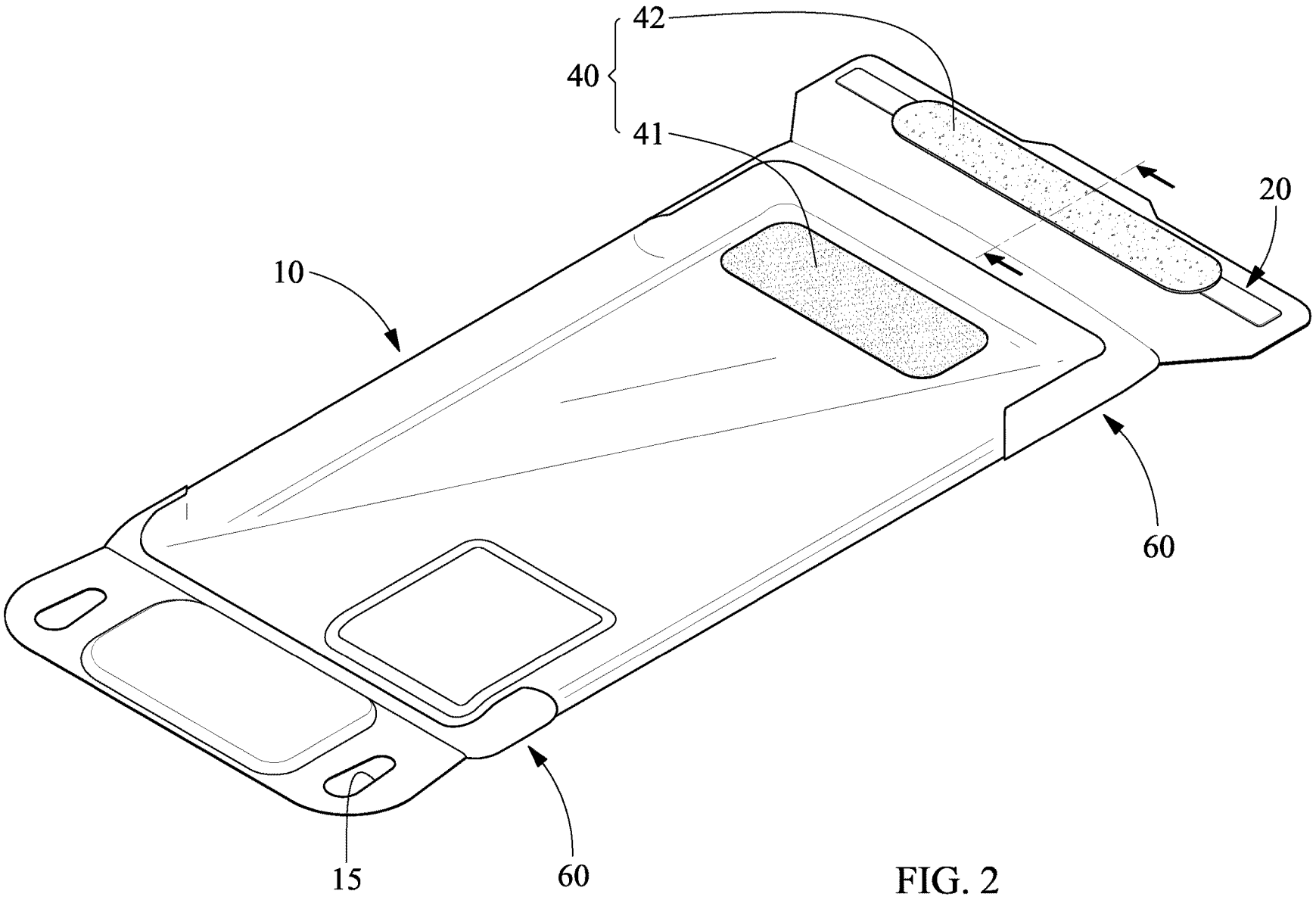
FIG. 2 is another perspective view of the vacuum storage apparatus shown in FIG. 1.
Figure 3:
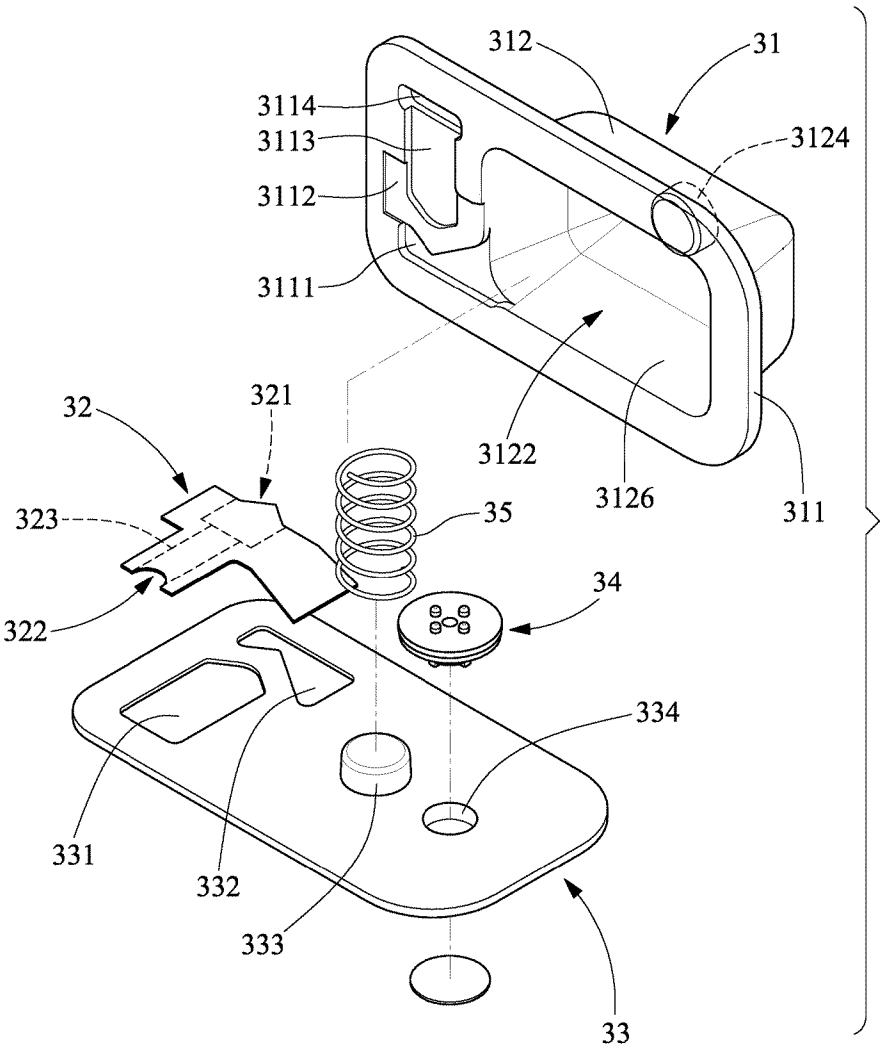
FIG. 3 is an exploded view of a pump used on the vacuum storage apparatus shown in FIG. 1.
Figure 4:
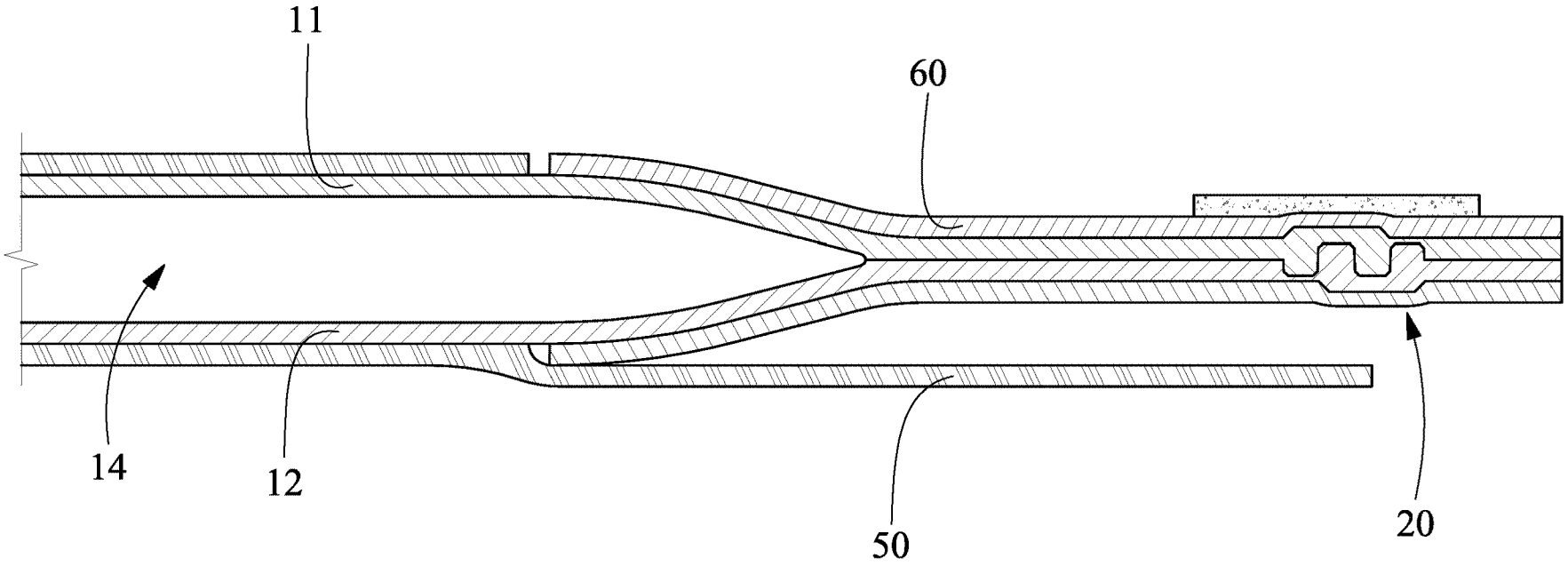
FIG. 4 is an enlarged partial and cross-sectional view of the vacuum storage apparatus shown in FIG. 1.
Figure 5:
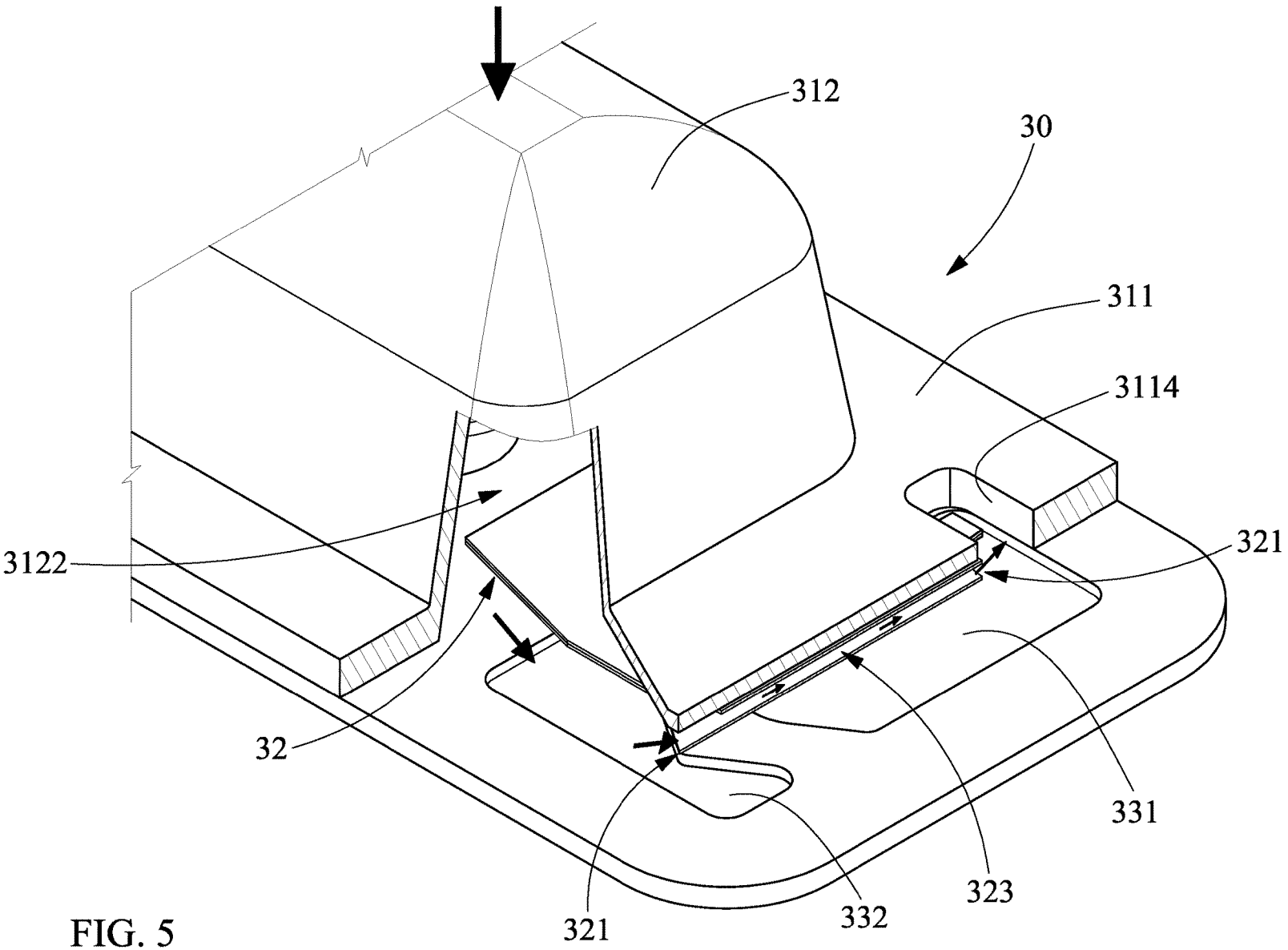
FIG. 5 is an enlarged partial and cut-away view of the vacuum storage apparatus shown in FIG. 1.

Referring to FIGS. 1 to 5, a vacuum storage apparatus includes a bag 10, at least one zipper 20, a pump 30, at least one hook-and-loop means 40, a fin 50, and at least one reinforcing strip 60 according to a first embodiment of the present invention. The bag 10 includes two sheets 11 and 12 connected to each other, leaving a mouth 13 along and between an edge of the sheet 11 and an edge of the sheet 12. The mouth 13 is in communication with a space 14 in the bag 10. The sheets 11 and 12 are flexible elements made of thermoplastic polyurethane (TPU) for example. The sheet 11 includes an aperture 112.

The bag 10 further includes two orifices 15. A nail or hook can be inserted in one of the orifices 15 so that the vacuum storage apparatus is hung on the nail or hook.

The zipper 20 is used to close the mouth 13. The zipper 20 includes a male element 21 and a female element 22. The male element 21 is connected to the sheet 11 (or the sheet 12) and the female element 22 is connected to the sheet 12 (or the sheet 11). The male element 21 can be inserted in the female element 22 to close the mouth 13.

The pump 30 is inserted in the aperture 112 and then connected to the sheet 11. The pump 30 includes a shell 31, a check valve 32, a bottom plate 33, a check valve 34, a spring 35, and a filter 36.

The shell 31 includes a flange 311 and an air bag 312. The flange 311 and the air bag 312 are formed in one piece. The flange 311 is inserted in the space 14 of the bag 10 and connected to the sheet 11. The air bag 312 extends to exterior of the bag 10 via the aperture 112.

The air bag 312 is elastic. The air bag 312 includes a chamber 3122 and a positioning boss 3124 extending from an internal face of the air bag 312. The air bag 312 further includes an opening 3126 in communication with the chamber 3122.

The flange 311 includes three recesses 3111, 3112 and 3113 and a vent 3114. The recesses 3111, 3112 and 3113 are made in a lower face of the flange 311. The recess 3111 is in communication with the recess 3112. The recess 3112 is in communication with the recess 3113. The recess 3113 is in communication with the vent 3114. The vent 3114 extends through the flange 311. The vent 3114 is in communication with the aperture 112 of the bag 10. The recess 3111 is in communication with the chamber 3122 of the air bag 312 through the opening 3126.

The check valve 32 is shaped in compliance with the recesses 3111, 3112 and 3113 in combination. The check valve 32 is fitted in the recesses 3111, 3112 and 3113. Preferably, the check valve 32 is firmly connected to the flange 311 via radio frequency heating for example. The check valve 32 includes an inlet 321, an outlet 322 and a channel 323. The inlet 321 is communication with the outlet 322 through the channel 323 that extends in the check valve 32. The check valve 32 preferably includes two membranes connected to each other so that the inlet 321, the outlet 322 and the channel 323 are defined between the membranes. The inlet 321 is larger than the outlet 322. The channel 323 is tapered as it extends to the outlet 322 from the inlet 321. The outlet 322 is in communication with the vent 3114.

An upper face of the bottom plate 33 is connected to a lower face of the flange 311. The bottom plate 33 includes two auxiliary holes 331 and 332, a restraining boss 333 and an entrance 334. The auxiliary holes 331 and 332 are made in the upper face of the bottom plate 33.

The auxiliary holes 331 and 322 are respectively shaped corresponding to the recesses 3113 and 3111. The auxiliary hole 332 is in communication with the recess 3111 to allow the check valve 32 to expand to an increased extent to allow an increased amount of air to go through the pump 30.

The restraining boss 333 is formed on the upper face of the bottom plate 33. The restraining boss 333 is located corresponding to the positioning boss 3124.

The entrance 334 extends through the bottom plate 33. The entrance 334 is located corresponding to the chamber 3122.

The check valve 34 is connected to the bottom plate 33, over the entrance 334, in the chamber 3122. The check valve 34 allows air to go into the chamber 3122 from the space 14 of the bag 10, but not vice versa.

The spring 35 includes an end fitted on the restraining boss 333 of the bottom plate 33 and another end fitted on the positioning boss 3124 of the shell 31.

The filter 36 is connected to a lower face of the bottom plate 33 corresponding to the entrance 334. The filter 36 and the check valve 34 are located on opposite sides of the entrance 334.

The hook-and-loop means 40 is located in the vicinity of the mouth 13. The hook-and-loop means 40 includes a hooked strap 41 and a looped strap 42. The hooked strap 41 is connected to a portion of the sheet 11 or 12 and the looped strap 42 is connected to another portion of the sheet 11 or 12. The hooked strap 41 and the looped strap 42 extend parallel to the mouth 13. The hooked strap 41 is engaged with the looped strap 42 after the bag 10 is folded in the vicinity of the mouth 13. Thus, the bag 10 is kept folded and adequately sealed.

The fin 50 is connected to a portion of the sheet 11 or 12 in the vicinity of the mouth 13. The fin 50 preferably includes two slots 51 in the vicinity of two ends, respectively.

The reinforcing strip 60 is connected a proper portion of the bag 10 such as a peripheral portion of the bag 10 around of the pump 30 and a portion of the bag 10 in the vicinity of the mouth 13. The reinforcing strip 60 is shaped corresponding to a profile of the bag 10. The reinforcing strip 60 is connected to the bag 10 by radio frequency heating for example.

In use, a thing such as a cell phone is inserted into the space 14 of the bag 10 via the mouth 13. The male element 21 of the zipper 20 is engaged with the female element 22 of the same to close the mouth 13, i.e., to seal the space 14 of the bag 10. Moreover, the hooked strap 41 of the hook-and-loop means 40 is engaged with the looped strap 42 of the same after the bag 10 is folded in the vicinity of the mouth 13 to enhance the sealing of the space 14 of the bag 10.

Then, the pump 30 is pushed to drive air out of the space 14 of the bag 10. In detail, the air bag 312 is pushed on the top so that the chamber 3122 is reduced and the spring 35 is compressed. Accordingly, the air goes into the entrance 334 of the check valve 34 from the chamber 3122 via the recess 3111 of the flange 311 and the auxiliary hole 332 of the bottom plate 33. Then, the air goes to the outlet 322 through the channel 323. The air goes out of the pump 30 via the vent 3114. Then, the air bag 312 is released to allow the air bag 312 and the spring 35 to recover. Thus, vacuum is created in the chamber 3122 to suck air into the chamber 3122 from the space 14 of the bag 10 via the check valve 34. This process is repeated for several times to create vacuum in the space 14 of the bag 10 to bring the sheets 11 and 12 into tight contact with the thing stored in the space 14.

In case where the thing stored in the space 14 is a cell phone that includes a touch screen and a camera, there is substantially no gap between the touch screen of the cell phone 14 and the sheet 11 or 12 or between the camera and the sheet 11 or 12. Thus, it is allowed to precisely operate the touch screen of the cell phone and adequately use a camera of the cell phone.

Figure 6:
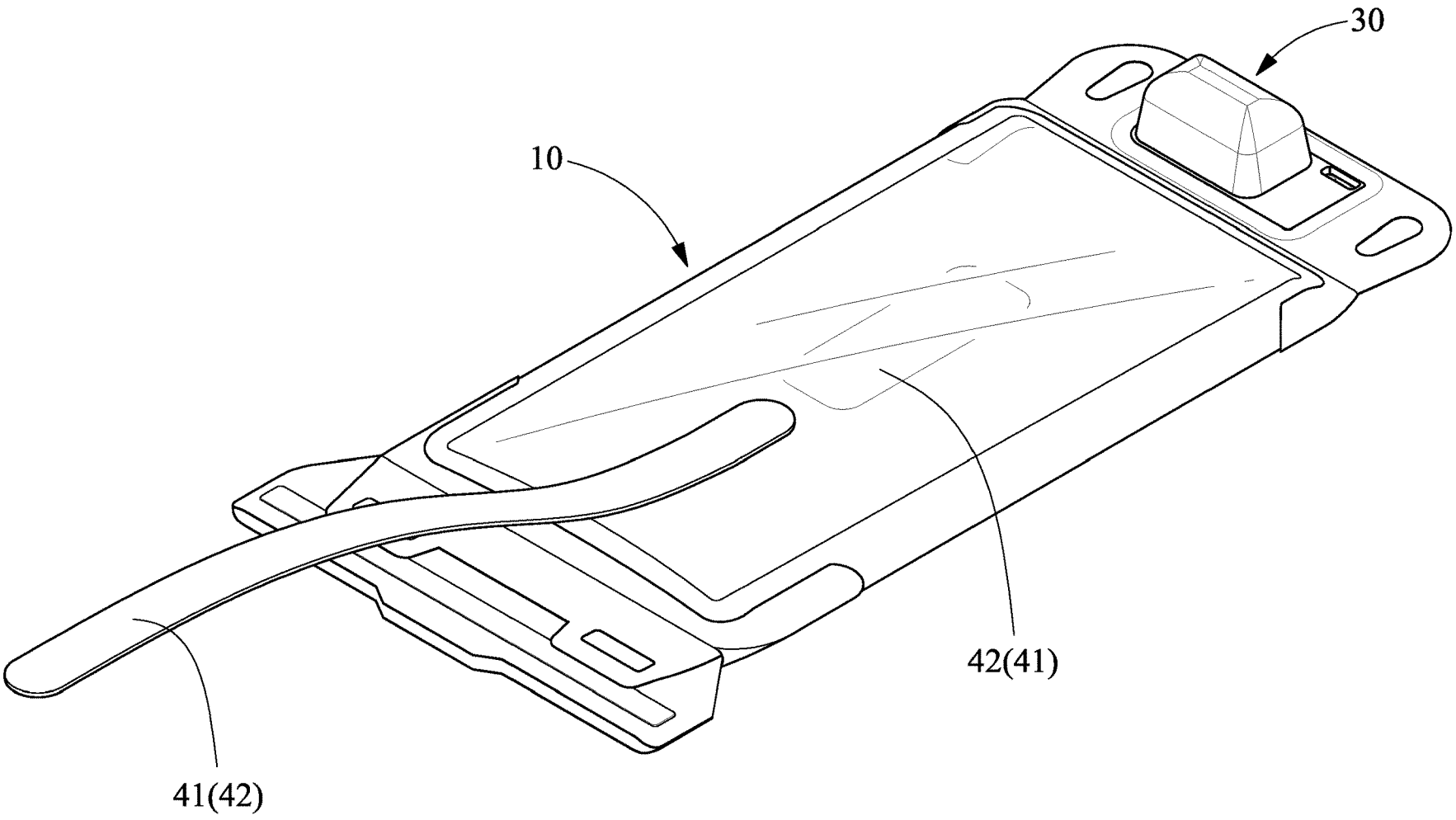
FIG. 6 is a perspective view of a vacuum storage apparatus according to the second embodiment of the present invention.
Figure 7:
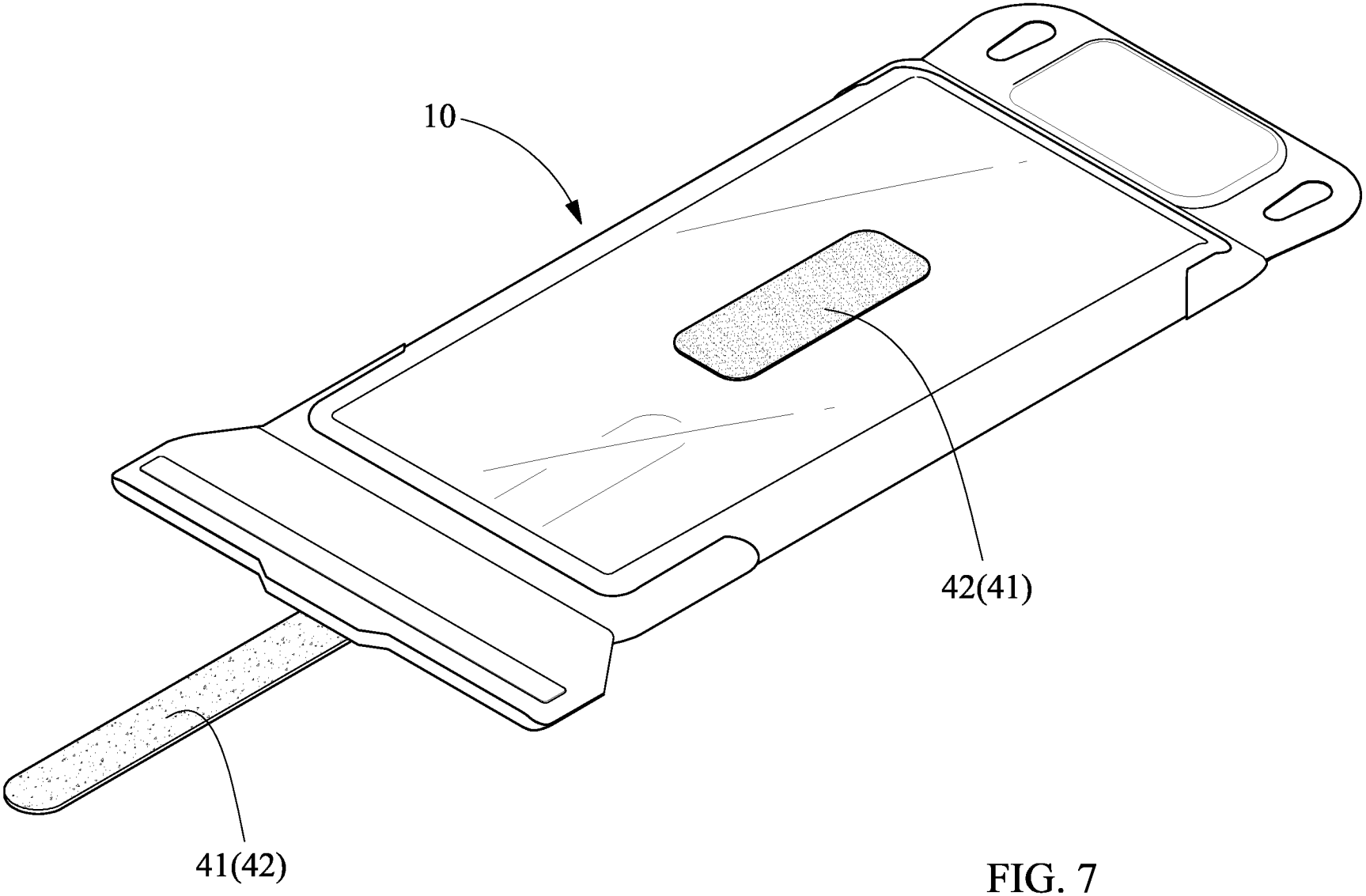
FIG. 7 is another perspective view of the vacuum storage apparatus shown in FIG. 6.
Figure 8:
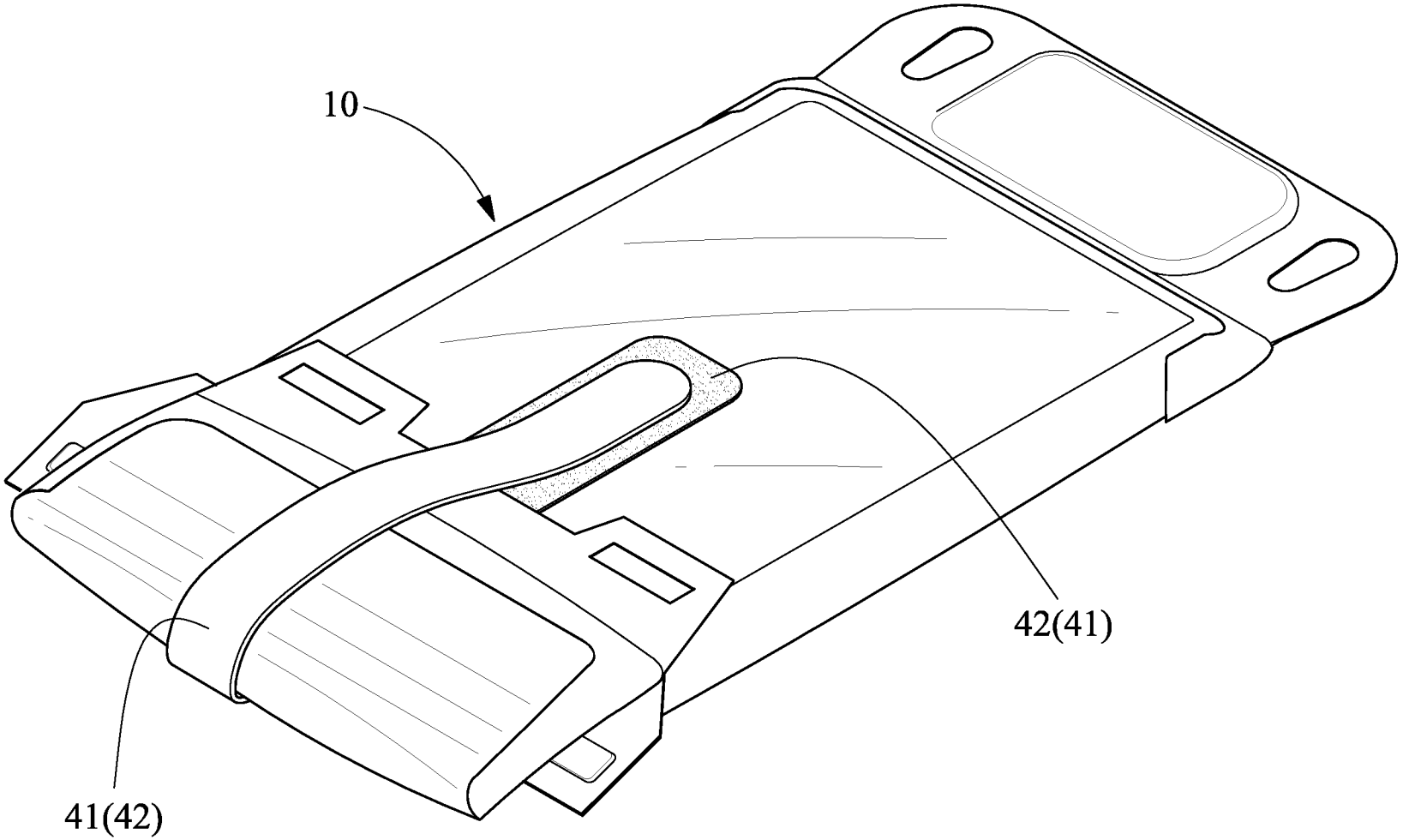
FIG. 8 is perspective view of the vacuum storage apparatus in another position than shown in FIG. 7.

Shown in FIGS. 6 through 8 is a vacuum storage apparatus according to a second embodiment of the present invention. The second embodiment is identical to the first embodiment except for connecting the hook-and-loop means 40 to the bag 10 in a different manner. The hooked strap 41 is connected to the sheet 11 (or 12) and the looped strap 42 is connected to the sheet 12 (or 11). The hooked strap 41 and the looped strap 42 extend perpendicular to the mouth 13. In operation, the hooked strap 41 is engaged with the looped strap 42 after the bag 10 is folded in the vicinity of the mouth 13. Thus, the bag 10 is kept folded.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. A vacuum storage apparatus comprising:

a bag comprising a mouth and an aperture;

a zipper operable to close the mouth; and a pump comprising:

a shell comprising:

an air bag comprising a chamber;

a flange extending from the air bag and comprising a vent in communication with the chamber, wherein the flange is inserted in and connected to the bag so that the air bag extends out of the aperture;

a bottom plate comprising an entrance, wherein the bottom plate is connected to the flange so that the entrance is in communication with the chamber;

a first check valve comprising a channel, an inlet, and an outlet in communication with the inlet via the channel, wherein the first check valve is located between the flange and the bottom plate so that the inlet is in communication with the chamber and the outlet is in communication with the vent; and a second check valve connected to the bottom plate, over the entrance.

2. The vacuum storage apparatus according to claim 1, wherein the flange comprises a recess for receiving the first check valve.

3. The vacuum storage apparatus according to claim 1, further comprising a hook-and-loop means operable to keep the bag folded.

4. The vacuum storage apparatus according to claim 1, wherein the hook-and-loop means comprises a hooked strap and a looped strap for engagement with the hooked strap.

5. The vacuum storage apparatus according to claim 4, wherein the hooked strap and the looped strap extend parallel to the opening.

6. The vacuum storage apparatus according to claim 4, wherein the hooked strap and the looped strap extend perpendicular to the opening.

7. The vacuum storage apparatus according to claim 1, further comprising a fin connected to the bag.

8. The vacuum storage apparatus according to claim 7, wherein the fin includes at least one slot.

9. The vacuum storage apparatus according to claim 1, wherein the pump further comprises a spring compressed between the air bag and the bottom plate.

10. The vacuum storage apparatus according to claim 9, wherein the air bag comprises a positioning boss formed on an internal face, wherein the bottom plate comprises a restraining boss formed on an internal face, wherein the spring comprises an end fitted on the positioning boss and another end fitted on the restraining boss.

11. The vacuum storage apparatus according to claim 1, wherein the bag comprise at least one orifice.

12. The vacuum storage apparatus according to claim 1, wherein the bag comprises a first sheet and a second sheet connected to the first sheet so that the mouth is located between an edge of the first sheet and an edge of the second sheet, wherein the aperture is made in the first sheet, wherein the flange is connected to the first sheet.

13. The vacuum storage apparatus according to claim 12, the zipper comprises a male element connected to one of the first and second sheets and a female element connected to the remaining one of the first and second sheets.

14. The vacuum storage apparatus according to claim 12, wherein the bag further comprises at least one reinforcing strip connected to the first and second sheets.

* * * * *